US005331822A

United States Patent [19]

Belliveau et al.

[11] Patent Number: 5,331,822

[45] Date of Patent: Jul. 26, 1994

[54] DEVICE FOR COOLING CHEMICAL SMOKE

[75] Inventors: Richard S. Belliveau; Jeffrey Maddox, both of Austin, Tex.

[73] Assignee: High End Systems, Inc., Austin, Tex.

[21] Appl. No.: 15,600

[22] Filed: Feb. 10, 1993

[51] Int. Cl.[5] ..... F25D 3/12

[52] U.S. Cl. ..... 62/168; 62/384; 252/305

[58] Field of Search ..... 252/305, 314; 62/384, 62/388, 165, 168

[56] References Cited

U.S. PATENT DOCUMENTS

| | | | |
|---|---|---|---|
| 2,475,755 | 7/1949 | Pearson | 62/384 |
| 3,661,483 | 5/1972 | Bose | 62/384 |
| 4,373,344 | 2/1983 | Hinn | 62/168 |
| 4,640,099 | 2/1987 | Gibot | 62/384 |
| 5,011,522 | 4/1991 | Suzuki | 62/388 |

OTHER PUBLICATIONS

Brightman, Fog . . . Foggier . . . Foggiest, Theater Crafts, Mar. 1987 (pp. 28, 29, 57-61).
Lighting Dimensions, Buyers Guide 1992/1993 (p. 107).
TCI Buyers Guide 93, Dec., 1992 (pp. 103-104).
Stiers Unterhaltungselektronik GmbH, Licht .Ton. Einrichtung Specials, 50 Spezial-Effekte und-Gerate.
Rosco Fog, "Lie Low for a While", Jul., 1991.
Le Maitre, (Table of Contents, pp. 10, 11), 1991.
Smoke Machine Co., Ltd., The Catalogue 90/9 Heavy Fog Model 6500.
Roboshot Dry Fogger (2 pages).

*Primary Examiner*—Ronald C. Capossela
*Attorney, Agent, or Firm*—Sixbey, Friedman, Leedom & Ferguson

[57] ABSTRACT

A device and method for cooling chemical smoke for creating a low lying fog effect comprises first and second chambers arranged in heat exchange relationship, the first chamber comprising an open-ended conduit adapted for maintaining a flow of chemical smoke therethrough, the second chamber adapted for receiving liquid $CO_2$ under pressure and including vent openings for venting gases from the second chamber into the first chamber for maintaining the second chamber at ambient pressure, the liquid $CO_2$ transforming to dry ice in situ, and a liquid $CO_2$ supply system for connecting a source of liquid $CO_2$ under pressure to the second chamber, whereby the chemical smoke flowing through the first chamber is cooled by the dry ice in the second chamber. Thermal sensor means sense the temperature in the second chamber and control a liquid $CO_2$ flow control valve in the liquid $CO_2$ supply system.

28 Claims, 3 Drawing Sheets

DEVICE FOR COOLING CHEMICAL SMOKE

FIELD OF THE INVENTION

The present invention relates generally to devices for creating fog effects and, more particularly, to a device for cooling chemical smoke for creating a low lying fog effect.

BACKGROUND OF THE INVENTION

Smoke (sometimes called "fog") has been a tool of the entertainment industry for decades for creating atmosphere as well as for making lighting effects more visible. For this reason smoke has found extensive use in the theater, movies, rock concerts, commercials, nightclubs and discotheques. In the past the fluids used in commercial smoke generators produced a chemical smoke which, while aesthetically satisfactory, created safety problems such as slippery floors, toxicity and fire. However, with the more recent advent of water-based and non-toxic glycol-based chemical smoke producing fluids the use of smoke generating machines in the entertainment industry has grown at an incredible rate.

Chemical smoke or fog generating machines produce, for the most part, smoke-type fog which hangs in the air and is particularly useful for creating effects such as smoke in battle scenes or the atmosphere of a large smoke filled room. Chemical smoke or fog is also very useful as a dispersion media to create interference for the optical viewing of collimated and non-collimated light. However, chemical smoke or fog is not effective for producing a low lying fog effect, i.e., a low lying cloud which dissipates as it begins to rise, such as an atmospheric mist hovering close to the ground. Heretofore, the low lying fog effect was created by use of dry ice foggers wherein the dry ice vapors themselves created the low lying mist. Although effective for this purpose, such mists present a potentially lethal hazard, particularly in small enclosed spaces, because dry ice mist is made up of carbon dioxide which may interfere with the availability of oxygen for breathing. Moreover, a special dry ice fogger is required so that separate generators must be available depending on the type of fog effect desired. In addition, dry ice is difficult to obtain, hazardous to handle and expensive to use.

SUMMARY OF THE INVENTION

It is, therefore, an object of the present invention to provide an innovative, low cost device for safely creating a low lying fog effect.

It is another object of the invention to provide a device capable of converting large volumes of chemical smoke into dense, white clouds of low lying fog.

It is still another object of the invention to provide a device capable of creating a wide range of low lying fog effects, ranging from a continuous layer to a large cloudburst.

It is yet another object of the invention to provide a new and improved device which cools chemical smoke to create a low lying fog effect.

It is another object of the invention to provide a device for exchanging heat between chemical smoke and dry ice in order to sufficiently cool the chemical smoke for creating a low lying fog effect.

It is still another object of the invention to provide a new and improved heat exchange device for exchanging heat between chemical smoke and dry ice wherein the dry ice is formed in situ within the device from liquid $CO_2$ supplied thereto.

It is another object of the invention to provide a device for cooling chemical smoke for creating a low lying fog effect comprising an open ended conduit for receiving chemical smoke in one end and discharging chemical smoke out the other end, a closed chamber surrounding the open ended conduit, liquid $CO_2$ input means for connecting a source of liquid $CO_2$ under pressure to the closed chamber and means in the closed chamber for venting gases to ambient.

It is yet another object of the invention to provide a device for cooling chemical smoke for creating a low lying fog effect comprising first and second chambers arranged in heat exchange relationship, the first chamber adapted for maintaining a flow of chemical smoke therethrough, the second chamber adapted for receiving liquid $CO_2$ under pressure and including means for venting gases to ambient for transforming the liquid $CO_2$ to dry ice in situ, and liquid $CO_2$ input means for connecting a source of liquid $CO_2$ under pressure to said second chamber, whereby the chemical smoke flowing through the first chamber is cooled by the dry ice in the second chamber.

It is still another object of the invention to provide a device for cooling chemical smoke for creating a low lying fog effect including flow control means for controlling the flow of liquid $CO_2$ under pressure to a second chamber which is in heat exchange relationship with a first chamber through which chemical smoke flows to be cooled, the flow control means including a liquid $CO_2$ flow control valve and thermal sensor means for sensing the temperature within the second chamber and for controlling the flow control valve in response thereto.

It is a further object of the invention to provide a method for cooling chemical smoke for creating a low lying fog effect involving the steps of flowing chemical smoke through a first chamber, providing a second chamber in heat exchange relationship with the first chamber, charging liquid $CO_2$ under pressure into the second chamber and transforming the liquid $CO_2$ to dry ice in the second chamber, whereby the chemical smoke flowing through the first chamber is cooled by the dry ice in the second chamber.

BRIEF DESCRIPTION OF THE DRAWINGS

The invention will be better understood from the following description taken in conjunction with the accompanying drawings in which.

DESCRIPTION OF THE PREFERRED EMBODIMENT

Figure 1:
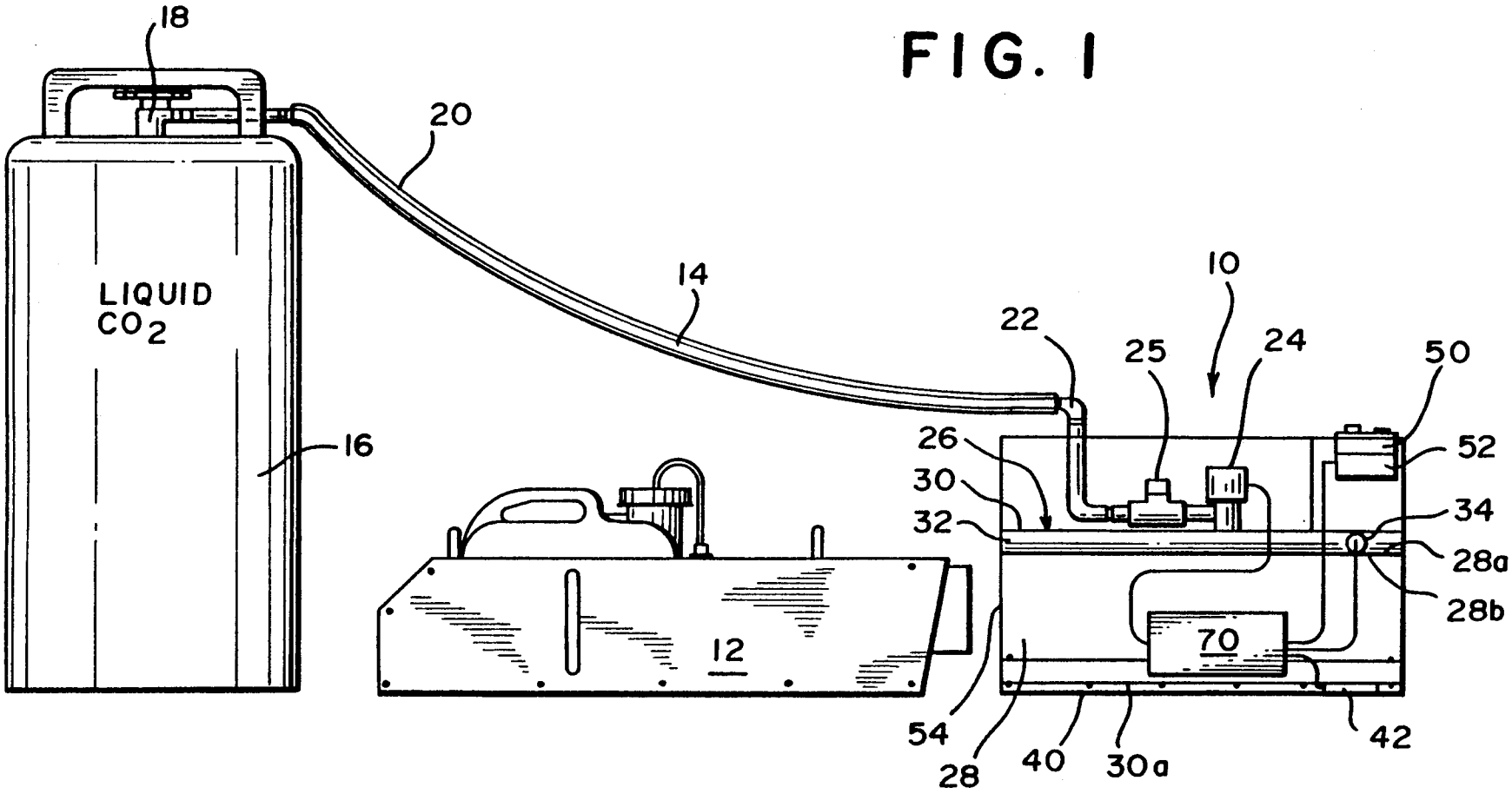
FIG. 1 is a schematic representation of the chemical smoke cooling device of the present invention.

Referring first to FIG. 1, the present invention comprises a cooling unit 10 for converting, by cooling, chemical smoke generated in a chemical smoke generating machine 12 into a wide range of low lying fog effects. Unit 10 connects, via a flexible transfer hose 14, to a liquid $CO_2$ tank 16 for providing liquid $CO_2$ to unit 10 for cooling the unit. Tank 16 may remain connected to unit 10 when the unit is used as a permanent installation. When unit 10 is to be transported and used in a remote location, liquid $CO_2$ tank 16 may be disconnected and unit 10 operated without the tank to convert chemical smoke into a low-lying fog effect. Unit 10 is brought to its optimum or "ready" cooling temperature (about −80° to −110° F.) by the introduction of liquid $CO_2$ and its subsequent transformation to dry ice, as will be described hereinafter in greater detail. At that time chemical smoke from smoke generating machine 12 is directed into cooling unit 10 in which it is cooled by indirect heat transfer with the dry ice to create a variety of low-lying fog effects.

Liquid $CO_2$ tank 16 is a conventional high pressure vessel capable of storing and dispensing, via valve 18, liquid $CO_2$ for use in the present invention. Such tanks are known as Dewar vessels and are typically available commercially from welding supply and inert gas supply dealers. It is preferred that tank 16 be capable of storing liquid $CO_2$ and operating in the range 21 BAR (300 psig) to 24 BAR (350 psig).

Transfer hose 14 is a conventional flexible metal hose used in the transfer of cryogenic-type fluids. Although it may be employed in any desired length it should be appreciated that the longer the transfer hose, the longer it will take cooling unit 10 to reach its optimum or "ready" operating temperature. In addition, the longer the transfer hose the greater the opportunity for undesirable heating of the liquid $CO_2$ enroute from liquid $CO_2$ tank 16 to the cooling unit 10. Therefore, it is highly recommended that the transfer hose 14 be insulated. Insulation will not only reduce the time involved in cooling unit 10 but also will prevent frost build-up on the hose. Insulation will also protect the operator from possible injury resulting from exposure to the very cold surface of the hose during operation.

The transfer hose 14 may be insulated using common pipe insulation 20 available at most retail hardware or plumbing supply stores. For example, suitable insulation is available in elongated elastomeric tubes which are split along their length for easy wrap-around installation. The tubes of insulation should preferably be wrapped around the transfer hose 14 along its entire length and then taped or glued in place. Depending upon the amount of insulation desired, tubes having wall thicknesses of from ½-inch to 1-inch may be conveniently used to achieve insulation factors between R3.0 and R7.2.

In order to operate unit 10 the transfer hose 14 must be securely attached to the dispensing valve 18 on the liquid $CO_2$ tank 16. To insure a positive seal a nylon washer (not shown) is desirably installed in the tank's valve/transfer hose connection. If the transfer hose 14 is not already installed on cooling unit 10 it must be securely attached to liquid $CO_2$ inlet conduit 22.

The flow of liquid $CO_2$ from tank 16 through transfer hose 14 is controlled by cryogenic solenoid valve 24. A safety relief valve 25 which vents to the ambient is positioned upstream of solenoid valve 24 to provide overpressure protection in the liquid $CO_2$ line. When the cooling unit 10 is enabled via the remote control unit 50 and the system electronics 70, as will be more fully described hereinafter, the cryogenic solenoid valve 24 opens to allow liquid $CO_2$ to flow under pressure between tank 14, at about 300–350 psig, and cooling module 26 of cooling unit 10 at atmospheric pressure.

Figure 2:
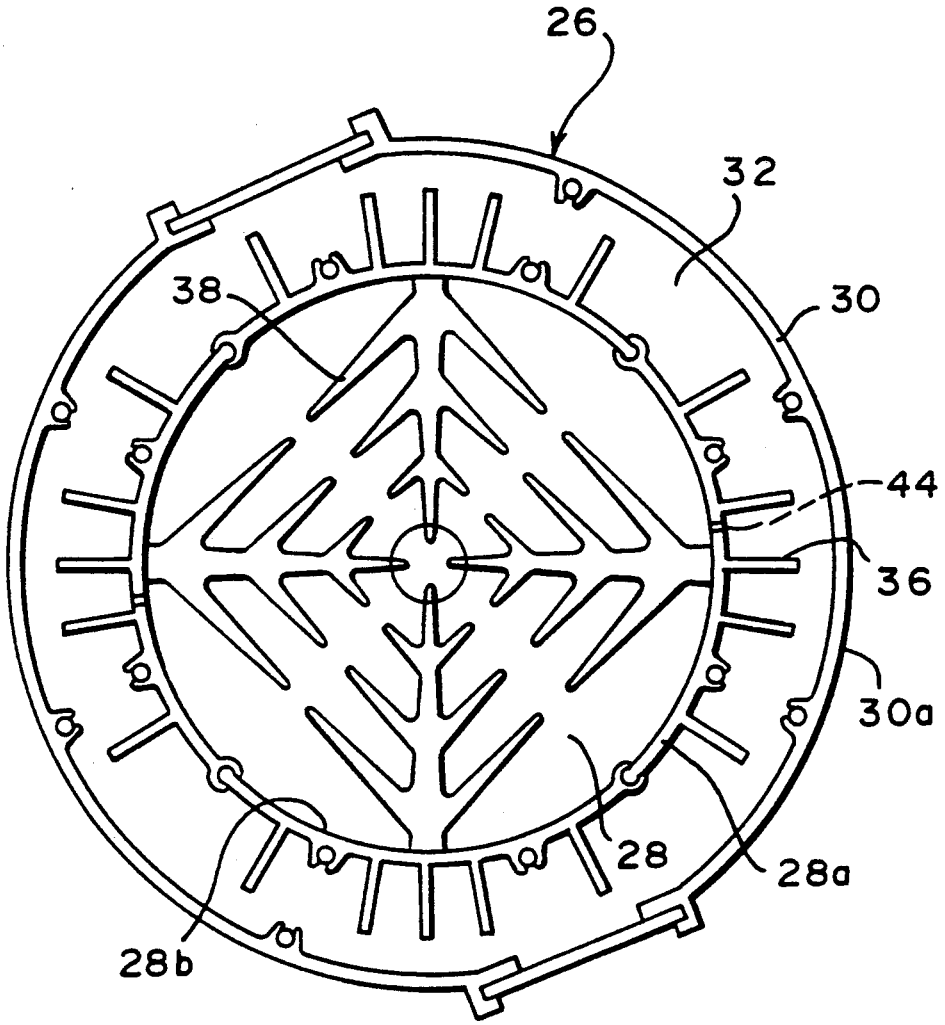
FIG. 2 is an end view of the containment chamber and cooling tunnel of the chemical smoke cooling device of the present invention.

More specifically, and with reference to FIGS. 1 and 2, cooling module 26 comprises an open-ended tubular cooling tunnel 28 surrounded by a generally concentric, tubular, closed containment vessel 30. The annular space defined between cooling tunnel 28 and containment vessel 30 forms a closed containment chamber 32 into which the liquid $CO_2$ flows from cryogenic valve 24. Due to the sudden pressure decrease from 300–350 psig to ambient the liquid $CO_2$ solidifies in containment chamber 32 to form dry ice particles and cools in the process to the "ready" temperature of about −80° F. to −110° F. It is at this temperature that the cooling unit 10 operates optimally to convert chemical smoke into a low lying fog. A thermocouple-type thermal sensor 34 is positioned on the wall 30 of containment chamber 32 and is electrically connected within the system electronics 70 to monitor the temperature within chamber 32 as an indication of the readiness of the unit 10 to operate for its intended purpose.

A plurality of heat exchange fins 36 project from the outer surfaces of the cooling tunnel walls **28*a* into the containment chamber 32 to facilitate heat exchange between the dry ice and walls 28*a* to cool the walls. A plurality of branched, high surface area evergreen tree-like heat exchange fins 38 project inwardly from the inner surfaces of the cooling tunnel walls 28*b* toward the center of the cooling tunnel 28. These fins 38 facilitate heat exchange between walls 28*b* and the chemical smoke produced by smoke generator 12 which is directed through cooling tunnel 28 over fins 38. As the heat exchange process takes place the dry ice absorbs heat and vaporizes and the resulting $CO_2$ gas is vented from containment chamber 32 into cooling tunnel 28 via vent opening 44 formed in the cooling tunnel wall 28*a,b*. The $CO_2$ gas is swept out of tunnel 28 of the unit 10 by the flow of chemical smoke therethrough. Due to the very low temperatures employed, condensation of water occurs on the outer surfaces of the containment vessel walls 30*a*. The condensed water collects in drip pan 40 in which condensate heater 42 is positioned to evaporate the water. The condensate heater 42 is always on when there is power being supplied to unit 10 and is thermostatically controlled to a predetermined temperature which is sufficient to evaporate the water entering drip pan 40. The vapor produced by condensate heater 42** is vented to ambient.

In view of the very cold temperatures at which unit 10 operates and its proximity to chemical smoke generator 12, the cooling unit 10 of the present invention is most typically positioned somewhat remote (typically 10–100 feet) from the operator. As a result, it is preferable that unit 10 includes an optional remote control capability. Generally, the remote control system includes a remote control operating unit 50 which may be connected via an extension cable (not shown) to the cooling unit 10. As is well known, the remote connection may be cableless as well. However, from the standpoint of reliability of operation a cable-connected remote unit is preferred. In a particularly preferred form of the invention the remote control unit 50 is detachable from a piggy-back storage location on the cooling unit 10 and, when detached, exposes a plug 52 into which the cable may be connected.

Figure 3:
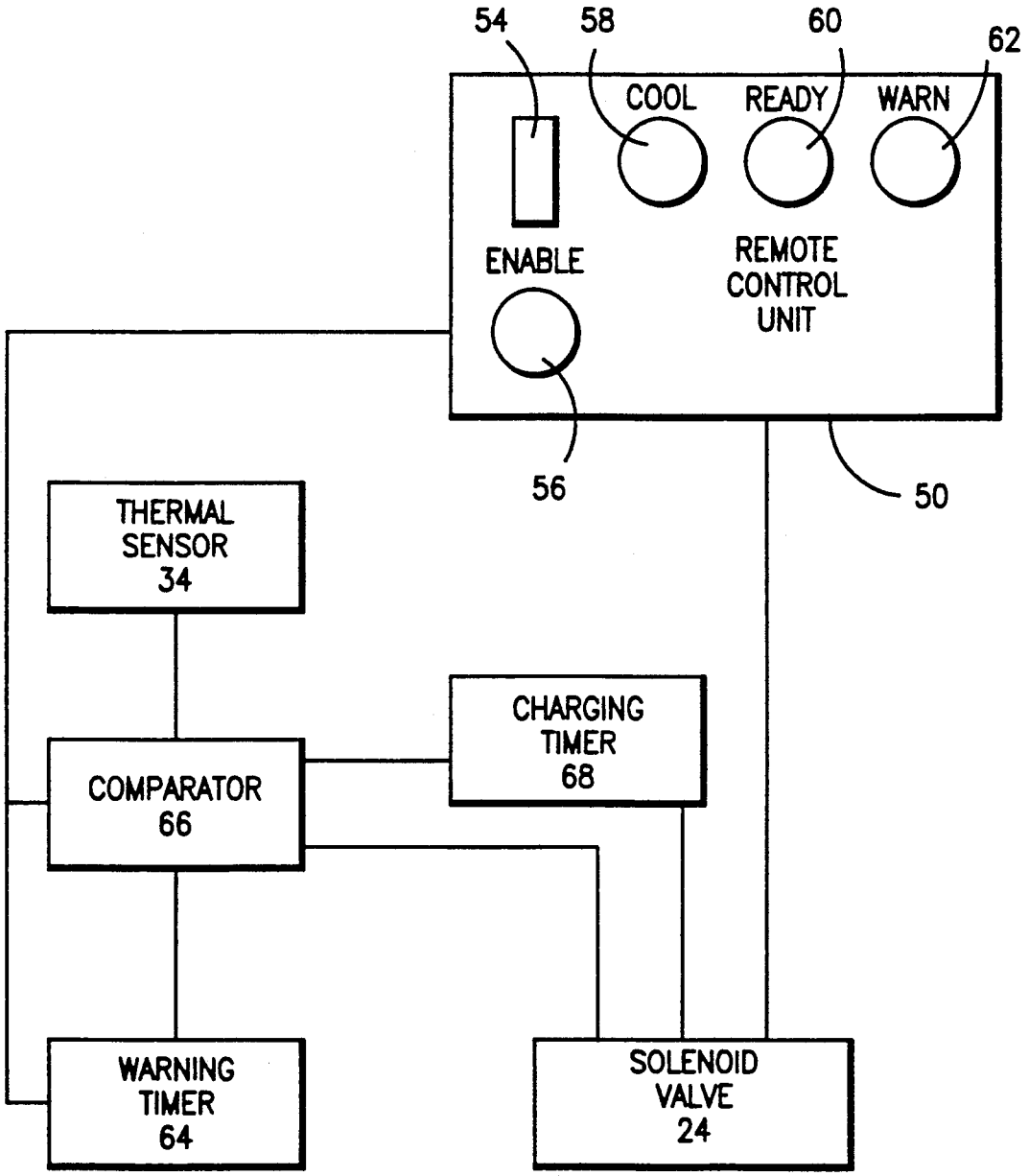
FIG. 3 is a block diagram of the electronic control system for the chemical smoke cooling device of the present invention.

With reference to FIG. 3, the optional remote control unit 50 comprises a press-to-engage, press-to-disengage ENABLE switch 54. An ENABLE LED 56 on the unit lights when the switch is in the enabled position. The unit 50 also includes three status LEDs: a COOLING LED 58 to indicate when the unit is in the COOLING mode with solenoid valve 24 open; a READY LED 60 to indicate when unit 10 is in a READY mode at its "ready" temperature; and a WARNING LED 62 to indicate when unit 10 fails to reach its "ready" temperature within a predetermined period of time. It should be appreciated that, if desired, remote control unit 50 may remain connected to plug 52 on cold flow unit 10 in the event that remote control operation is not desired.

Referring now to FIGS. 1, 2 and 3, to initiate liquid $CO_2$ flow from the tank 16 in which it is typically stored at about 0° F. and 300–350 psig, valve 18 is opened and the cooling unit 10 is enabled by operation of the ENABLE switch 54 on the remote control unit 50. This causes cryogenic solenoid valve 24 to open, allowing liquid $CO_2$ to flow from tank 16 through transfer hose 14, safety relief valve 25 and cryogenic solenoid valve 24 into the containment chamber 32 surrounding cooling tunnel 28. As hereinbefore described, in chamber 32 the liquid $CO_2$ transforms to dry ice. Operation of the ENABLE switch 54 also causes the unit's warning timer 64 to start and signals an electronic comparator unit 66 to monitor the voltage output of the containment chamber temperature sensor 34 to ascertain when the unit's optimum operating or "ready" temperature is reached. Depending upon the length of transfer hose 14 the time to fully charge containment chamber 32 will vary. For example, using a seven (7) foot transfer hose, the unit 10 requires about five (5) minutes to fully charge and to reach its optimum cooling charge level. Greater lengths of transfer hose require greater amounts of time to reach full charge. During the charging period, the COOLING LED 58 on the remote control unit 50 will be lit to show that the solenoid valve is open and containment chamber charging is taking place. When the output voltage of thermal sensor 34 signals the comparator that the "ready" temperature has been reached within containment chamber 32 a signal is sent to the unit's charging timer 68, which operates for five (5) minutes, instructing it to start. After five minutes the charging timer 68 closes solenoid valve 24 and the READY LED 60 lights indicating that the unit 10 is fully charged. In the event that the "ready" temperature is not reached within a specified time (e.g., 15–20 minutes), the warning timer 64 will shut the solenoid valve 24 and the WARNING LED 62 will light indicating that the liquid $CO_2$ tank 16 is possibly empty or that a pressure problem exists somewhere in the system. Once the "ready" temperature is reached, thermal sensor 34 maintains the proper operating temperature within the containment chamber 32 by continuously sensing the temperature within the chamber 32 and, via comparator 66, providing an electrical signal to open cryogenic valve 24 when the temperature is too high. When proper temperature has been again attained within the chamber 32 the sensor 34, via comparator 66, provides another electrical signal to close the cryogenic valve 24.

After unit 10 has been cooled to a sufficiently low temperature (about −100° to −110° F.) smoke generator 12 is positioned with its outlet proximate to the inlet opening 54 to cooling tunnel 28 such that the chemical smoke generated by generator 12 is directed into and enters cooling tunnel 28 of unit 10. A suitable smoke generator for use with unit 10 is a chemical smoke generator such as the F-100 Performance Smoke Generator available from Lightwave Research of Austin, Tex. Such a generator utilizes a chemical fluid such as Atmospheres Cold Flow Formula, also available from Lightwave Research of Austin, Tex., which is an atmospheric enhancement fluid designed for low lying fog effects. After it is properly positioned the smoke generator 12 is started and chemical smoke is produced. The smoke passes into cooling tunnel 28 through inlet opening 54 and, within tunnel 28, flows over, in contact with and is cooled by inner wall **28*b* and fins 38. The amount of smoke passing through the cooling tunnel 28** may be adjusted to create the desired low lying fog effect.

When use of the unit 10 is concluded, the ENABLE switch on the remote control unit 50 should again be operated to disengage the unit and to stop all flow of liquid $CO_2$ between tank 16 and unit 10. However, inasmuch as condensate may be present in drip pan 40, the unit 10 should remain connected to electrical power in order that condensate heater 42 may continue to operate in order to evaporate all such condensate.

In the event that unit 10 is to be transported it must be disconnected from the liquid $CO_2$ tank 16. Caution should be exercised to be sure that flow valve 18 on tank 16 is fully closed and that the fitting connecting the transfer hose 14 to tank 16 is loosened slowly to allow transfer line 14 to depressurize slowly. Depending upon when unit 10 was last operated, some condensate may remain in the drip pan 40. Inasmuch as it is necessary to disconnect unit 10 from the electrical power, a drain plug (not shown) is provided to allow removal of unevaporated condensate from the drip pan 40.

If unit 10 is to be used at a remote location it may be charged with liquid $CO_2$ prior to transporting it. This may be accomplished by charging unit 10, as previously described, to its maximum capacity (e.g., 11 kg (5 lbs.)) with liquid $CO_2$ and then disconnecting unit 10 from tank 16. At the remote location unit 10 will produce a low lying fog effect for approximately one hour at ambient conditions (about 24° C.).

We claim:

1. A device for cooling chemical smoke for creating a low lying fog effect comprising:

(a) an open ended conduit for receiving chemical smoke through one end and discharging chemical smoke through the other end;

(b) a closed chamber surrounding said open ended conduit;

(c) liquid $CO_2$ input means for connecting a source of liquid $CO_2$ under pressure to said closed chamber; and (d) means in said closed chamber for maintaining said chamber at ambient pressure.

2. A device for cooling chemical smoke for creating a low lying fog effect comprising:

(a) first and second chambers arranged in heat exchange relationship;

(b) said first chamber adapted for maintaining a flow of chemical smoke therethrough;

(c) said second chamber adapted for receiving liquid $CO_2$ under pressure and including means for transforming said liquid $CO_2$ to dry ice in situ; and (d) liquid $CO_2$ input means for connecting a source of liquid $CO_2$ under pressure to said second chamber;

whereby the chemical smoke flowing through said first chamber is cooled by the dry ice in said second chamber.

3. A device, as claimed in claim 2, wherein said transforming means comprises means in said second chamber for venting gases therein to ambient.

4. A device, as claimed in claim 2, further including flow control means for controlling the flow of liquid $CO_2$ under pressure into said second chamber.

5. A device, as claimed in claim 4, wherein said flow control means comprises a liquid $CO_2$ flow control valve and thermal sensor means for sensing the temperature within the second chamber and for controlling said flow control valve in response thereto.

6. A device, as claimed in claim 5, wherein said flow control means further includes timer means and said flow control valve is controlled in response to said sensed temperature and the operation of said timer means.

7. A device, as claimed in claim 4, wherein said flow control means comprises a liquid $CO_2$ flow control valve and manually operated switch means for controlling said flow control valve.

8. A device, as claimed in claim 7, wherein said switch means is located remotely from said flow control valve.

9. A device, as claimed in claim 8, wherein said liquid $CO_2$ input means includes said flow control valve.

10. A device, as claimed in claim 2, wherein said first chamber comprises an open ended conduit for receiving chemical smoke through one end and discharging chemical smoke from the other end.

11. A device, as claimed in claim 10, wherein said first chamber comprises a first substantially tubular conduit and said second chamber comprises the annular space defined between said first conduit and a second substantially tubular conduit concentric with and of greater diameter than said first conduit.

12. A device, as claimed in claim 11, wherein said second chamber is a closed chamber at ambient pressure.

13. A device, as claimed in claim 12, including vent means in the wall of said first conduit for venting gases in said second chamber into said first chamber.

14. A device, as claimed in claim 12, including fins extending into said first chamber from the inner surface of said first conduit walls and into said second chamber from the outer surface of said first conduit walls.

15. A device, as claimed in claim 14, wherein said liquid $CO_2$ input means includes a liquid $CO_2$ flow control valve.

16. A device, as claimed in claim 15, including thermal sensor means for sensing the temperature within said second chamber and for controlling said flow control valve in response thereto.

17. A device, as claimed in claim 16, further including timer means and wherein said flow control valve is controlled in response to said sensed temperature and the operation of said timer means.

18. A device, as claimed in claim 17, including means for collecting condensation which forms on the outer surface of said second conduit, means for evaporating said condensate and means for venting to ambient the vapors produced thereby.

19. A device, as claimed in claim 2, wherein said second chamber is a closed chamber surrounding said open ended conduit.

20. A device, as claimed in claim 2, including fins extending into said first chamber from the peripheral walls thereof for facilitating heat exchange between the dry ice in said second chamber and the chemical smoke flowing through said first chamber.

21. A device, as claimed in claim 2, including fins extending into said second chamber from the walls thereof for facilitating heat exchange between the dry ice in said second chamber and the chemical smoke flowing through said first chamber.

22. A method for cooling chemical smoke for creating a low lying fog effect comprising the steps of:

(a) flowing chemical smoke through a first chamber;
(b) providing a second chamber in heat exchange relationship with said first chamber;
(c) charging liquid $CO_2$ under pressure into said second chamber; and
(d) transforming said liquid $CO_2$ to dry ice in said second chamber, whereby the chemical smoke flowing through said first chamber is cooled by the dry ice in said second chamber.

23. A method, as claimed in claim 22, wherein said first chamber comprises an open ended conduit and said chemical smoke flows into one end and out the other end of said conduit.

24. A method, as claimed in claim 23, wherein said second chamber is a closed chamber surrounding said open ended conduit and including the steps of maintaining said second chamber at ambient pressure, monitoring the temperature of said second chamber and controlling the charging of liquid $CO_2$ into said second chamber in response to said monitored temperature.

25. A method, as claimed in claim 22, wherein said second chamber is a closed chamber surrounding said first chamber.

26. A method, as claimed in claim 22, wherein said second chamber is maintained at ambient pressure.

27. A method, as claimed in claim 22, wherein said liquid $CO_2$ is charged to said second chamber at about 300–350 psig.

28. A method, as claimed in claim 22, wherein the temperature within said second chamber is monitored and the charging of liquid $CO_2$ thereto is controlled in response to said monitored temperature.

* * * * *